US009745686B2

(12) United States Patent
Sar et al.

(10) Patent No.: US 9,745,686 B2
(45) Date of Patent: Aug. 29, 2017

(54) DRYER COMPRISING A DISMOUNTABLE MEMBER

(75) Inventors: Can Sar, Istanbul (TR); Veysel Ertan Cetinkaya, Istanbul (TR); Idris Burak Harac, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 813 days.

(21) Appl. No.: 13/976,980

(22) PCT Filed: Dec. 6, 2011

(86) PCT No.: PCT/EP2011/071903

§ 371 (c)(1),
(2), (4) Date: Nov. 22, 2013

(87) PCT Pub. No.: WO2012/089451

PCT Pub. Date: Jul. 5, 2012

(65) Prior Publication Data

US 2014/0150275 A1 Jun. 5, 2014

(30) Foreign Application Priority Data

Dec. 27, 2010 (TR) ..... 2010/10958

(51) Int. Cl.
*E05C 1/08* (2006.01)
*D06F 58/04* (2006.01)
(Continued)

(52) U.S. Cl.
CPC ..... *D06F 58/04* (2013.01); *D06F 39/14* (2013.01); *D06F 58/22* (2013.01); *D06F 58/24* (2013.01); *E05C 1/085* (2013.01)

(58) Field of Classification Search
CPC .... Y10S 292/37; Y10S 292/11; Y10S 292/04; Y10T 292/0969; Y10T 292/097;
(Continued)

(56) References Cited

U.S. PATENT DOCUMENTS 1,768,021 A * 6/1930 Bauerband ..... E05B 47/0002 292/144
2,540,725 A * 2/1951 Geldhof ..... D06F 58/22 292/169
(Continued)

FOREIGN PATENT DOCUMENTS

BE EP 1964962 A1 * 9/2008 ..... D06F 37/42
CN 1888271 A 1/2007
(Continued)

OTHER PUBLICATIONS

International Search Report and Written Opinion for PCT/EP2011/071903 (submitted with application) and documents cited therein except for any documents that may not qualify as prior art.

*Primary Examiner* — Alyson M Merlino
(74) *Attorney, Agent, or Firm* — Kilpatrick Townsend & Stockton LLP

(57) ABSTRACT

The present invention relates to a dryer (1) comprising a body (2), a drum (3) disposed inside the body (2), wherein the laundry to be dried is placed, an opening (4) which is situated on the body (2), a dismountable member (5) which is placed into the body (2) by being passed through the opening (4), whereon the particles in the air leaving the drum (3) are accumulated and a lid (6) which covers the opening (4) so as to close the front of the dismountable member (5).

9 Claims, 4 Drawing Sheets

Figure 1:
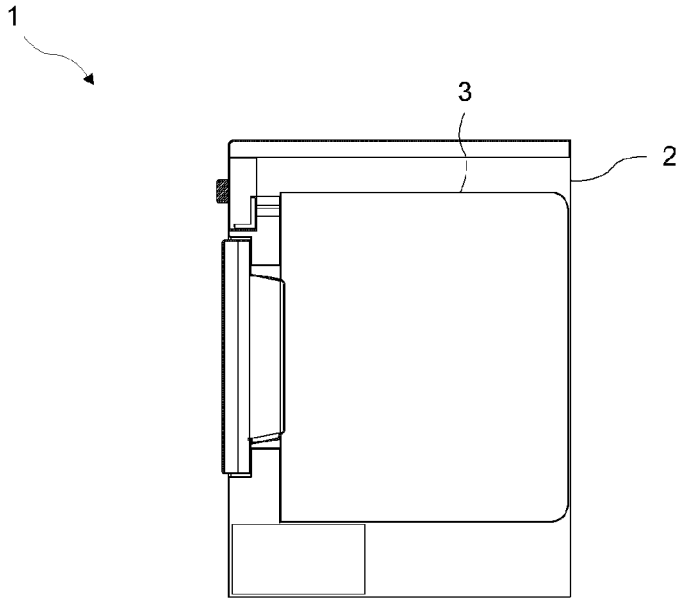

(51) Int. Cl.
*D06F 58/22* (2006.01)
*D06F 39/14* (2006.01)
*D06F 58/24* (2006.01)
*E05C 1/12* (2006.01)

(58) Field of Classification Search
CPC ..... Y10T 292/0976; Y10T 292/1014; Y10T 292/1016; E05C 1/085; D06F 39/14; D06F 58/04; D06F 58/22; D06F 58/24
USPC ..... 292/163, 164, 170, 138, 140, DIG. 37
See application file for complete search history.

(56) References Cited

U.S. PATENT DOCUMENTS 2,726,889 A * 12/1955 Lawson ..... E05C 1/14 292/170
3,609,265 A * 9/1971 Garbe ..... H01H 3/163 200/4
4,875,721 A * 10/1989 Okamoto ..... E05C 9/02 126/197
5,356,186 A * 10/1994 Favaro ..... A47L 15/4259 292/170
5,626,374 A * 5/1997 Kim ..... E05C 1/145 292/137
7,410,194 B2 * 8/2008 Chen ..... E05C 1/14 292/37
7,441,813 B2 * 10/2008 Qin ..... H04B 1/3883 292/163
7,806,446 B2 * 10/2010 Oh ..... B60R 7/06 292/137
2010/0107703 A1 * 5/2010 Hisano ..... D06F 25/00 68/20

FOREIGN PATENT DOCUMENTS

DE EP 1213415 A1 * 6/2002 ..... D06F 39/14
DE 102008027727 B3 * 7/2009 ..... D06F 37/28
DE 102008029364 A1 * 12/2009 ..... D06F 39/02
EP 0538655 A1 4/1993
GB 649071 A * 1/1951 ..... E05C 1/14
GB 1417833 A 12/1975
GB 1528401 A * 10/1978 ..... D06F 39/14
IT WO 2007085408 A1 * 8/2007 ..... D06F 58/24
JP 10239468 A * 9/1998
JP H10 239468 A 9/1998
KR 20040024200 A 3/2004
NL EP 0538655 A1 * 4/1993 ..... D06F 58/04
WO 2007/085408 A1 8/2007

* cited by examiner

DRYER COMPRISING A DISMOUNTABLE MEMBER

The present invention relates to a dryer comprising a dismountable member.

In state of the art dryers, the wet laundry placed into a rotating drum are provided to be dried by being contacted with hot air. The hot circulation air evaporates the moisture of the laundry that it passes over and sweeps it away from the laundry. While passing through a heat exchanger, preferably a condenser, the hot air enters into heat exchange with a fluid having a lower temperature, preferably air, and leaves there the moisture that condenses due to the temperature difference. The said heat exchange causes the circulation air to be cooled as well as to be dried by leaving its moisture. After passing through the condenser, the circulation air is heated by being passed through a heater disposed on a point further on the air channel and is sent again to the drum.

The condensers used in the dryers are configured such that the hot circulation air enters from one side and the fluid with a lower temperature, for example the cooling air, enters from the other side without mixing with the circulation air. While the hot circulation air removes the moisture of the laundry in the drum, the particles such as fiber and fluff formed in clothes due to usage also mix into the air together with the moisture. These particles cause the condenser to be clogged or cause the performance of the condenser to decrease in due course. Thus, the air leaving the drum is required to be passed through filters. The particles that leave the laundry and mix into the air are first held by the lid filter. The particles that cannot be held by the lid filter are held in the filter box behind the kick plate before reaching the condenser. The lid filter and the filters in the filter box are required to be periodically cleaned by the user by being dismounted.

In other state of the art embodiments, the condenser, together with the filter, is also mounted to its place in the dryer such that the user can place it into its place after dismounting and cleaning.

In these state of the art embodiments, an opening is situated on the dryer body for mounting and dismounting the condenser and the filter disposed before the condenser. The opening is closed by means of a lid at the same level with the body in order to prevent the entry of foreign materials into the dryer and provide visual integrity.

In the state of the art Chinese Patent Application No CN1888271, a dryer is explained comprising a lid mounted to the body by means of the horizontal hookers disposed at the lower edge thereof and the vertical hookers disposed at the upper edge thereof.

In another state of the art embodiment, the United Kingdom Patent Application No. GB1417833, a dryer is explained comprising a lid that is pivoted to the body so as to be opened by rotating such that one edge of the lid is the rotational axis. A handle is disposed at the free side edge of the lid. The handle extends towards above the water receptacle situated right next to the lid and provides the lid to be automatically opened by being actuated when the water receptacle is pulled for filling.

The aim of the present invention is the realization of a dryer comprising a condenser and/or filter which can be easily mounted and dismounted.

In the dryer realized in order to attain the aim of the present invention and explicated in the attached claims, the opening, which is disposed on the body and which enables a dismountable member such as condenser, filter etc. to be placed into the body, is closed by means of a lid.

The dryer comprises a release mechanism disposed on the body. When actuated by the user, the release mechanism transforms the vertical component of the force applied by the user into horizontal force and thus provides the lid to be opened. Thus, in order to reach the dismountable member, the user can easily open the lid by actuating the release mechanism.

In an embodiment of the present invention, at least one housing is disposed on the lid. The lock, disposed on the body, enters into the housing when the lid is closed and provides the lid to be kept in this position. When actuated, the release mechanism provides the lock to be pulled out of the housing by transforming the vertical force applied by the user into horizontal force and thus the lid is opened by becoming free.

In this embodiment, the release mechanism comprises a pusher which provides the vertical force to be transformed into the horizontal force. The pusher moves towards into the body and pushes the lock when the user actuates the release mechanism. As a result of the pushing, the lock comes out of the housing by moving in the horizontal direction and thus the lid is opened by becoming free.

The pusher comprises a button to be pressed by the user having a flat surface at the same level with the body and a push arm the end of which is in the form of an inclined plane and which extends towards into the body from the button. A pressing surface, against which the push arm bears, is provided on the lock The pressing surface is in the form of an inclined plane that is angled with the end of the push arm in the opposite direction. When the pusher is pushed and thus the push arm moves forward in the vertical direction, the end of the push arm in the form of an inclined plane pushes the pressing surface. Being inclined in the opposite direction, the pressing surface moves backwards in the horizontal as a result of the force acting thereon. In this embodiment, the lock furthermore comprises at least one tenon connected to the pressing surface and which provides locking by being seated into the housing. When the pressing surface moves backwards in the horizontal, the tenon to which the pressing surface is connected comes out of the housing by receding back and thus the lid becomes free.

In an embodiment of the present invention, a bearing, which bears the lock and into which the lock is placed so as to move, is fixed to the body. In this embodiment, a spring is placed between the bearing and the lock. The spring is compressed when the tenon recedes as the user actuates the pusher for opening the door. When the pusher becomes free by the opening of the door afterwards, the spring pushes the tenon in order that the tenon resumes its former position In an embodiment of the present invention, the lock is placed into the bearing by means of a rail-slide mechanism. The bearing furthermore comprises a stopper which prevents the lock from coming out after being placed thereinto. The stopper is configured as a detent means over which the lock leaps by compressing while being placed into the bearing.

In an embodiment of the present invention, the lock comprises two tenons and two pressing surfaces disposed near each tenon, between the tenons. In this embodiment, a support, which extends between the pressure surfaces, is disposed. The support contacts the stopper from the front. The spring is disposed behind the support. The support and hence the entire lock compress the spring when they move backwards in order that the release mechanism is actuated and thus the tenons come out of the housings. When released, the lock moves towards the stopper and stops by bearing against the stopper.

A casing, into which the pusher is placed, is disposed on the body. The pusher can move forward and backward inside the casing. An extension is disposed on the pusher in order that the pusher is placed into the casing such that the pressing surfaces and the inclined end of the push arm are aligned accurately. The extension and the recess on the casing are aligned only in the right position. Thus, assembly errors are minimized. Detent means, which provide the pusher to be kept inside the casing, are provided at the edges of the pusher.

In an embodiment of the present invention, while the tenon provides locking by being seated into the housing, a protrusion on the lid is placed into a recess on the body. A prestress means compressed by the seating of the protrusion is disposed inside the recess. The recess is wider than the protrusion and when the tenon comes out of the housing, the lid becomes free. In this situation, the compressed prestress means provides the lid to be opened quickly by pushing the lid in order to change to the free position. The stress constant of the prestress means is determined according to the angle by which the lid is desired to be opened.

In an embodiment of the present invention, the opening and the lid are disposed at the front lower portion of the body. The front wall which closes preferably the front surface of the body ends at a level a little higher than the floor and a space that allows the placement of the dismountable member is left between the front wall and the base. The width of the dismountable member is less than the half of the width of the body. The front of the portion where the dismountable member is placed is covered by the lid. The body furthermore comprises a panel that closes the space that remains near the lid.

In different embodiments of the present invention, the dryer is a heat pump or conventional type dryer. Accordingly, the dismountable member can be a filter, a condenser or a condenser group wherein the filter and the condenser are present together.

A dryer realized in order to attain the aim of the present invention is illustrated in the attached figures, where:

FIG. 1—is the schematic view of a dryer.

Figure 2:
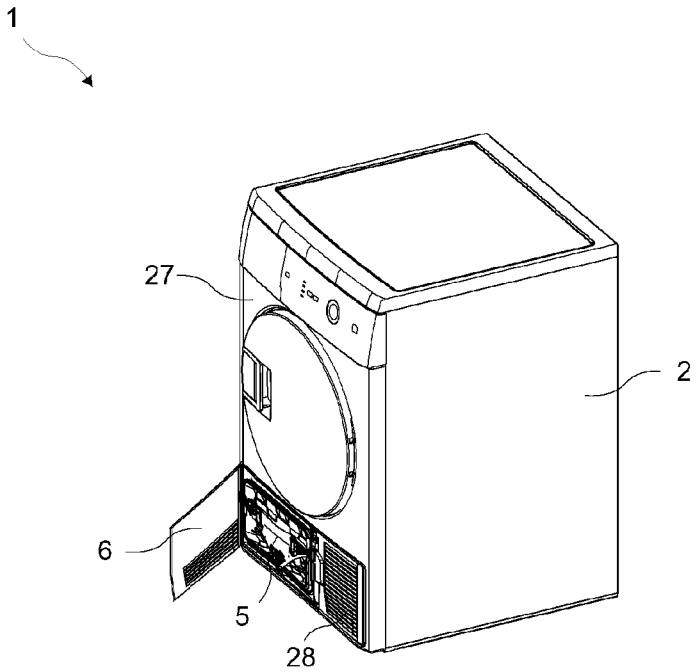

FIG. 2—is the perspective view of a dryer.

Figure 3:
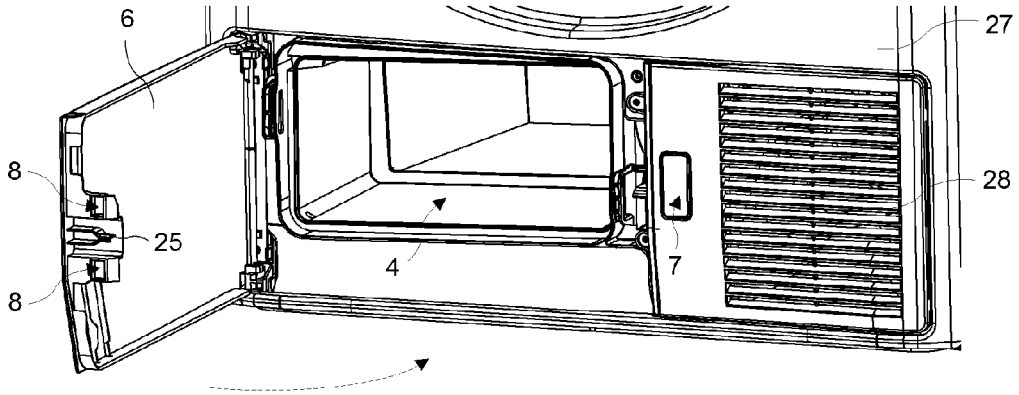

FIG. 3—is the partial view of a dryer when the lid is open and the dismountable member is outside.

Figure 4:
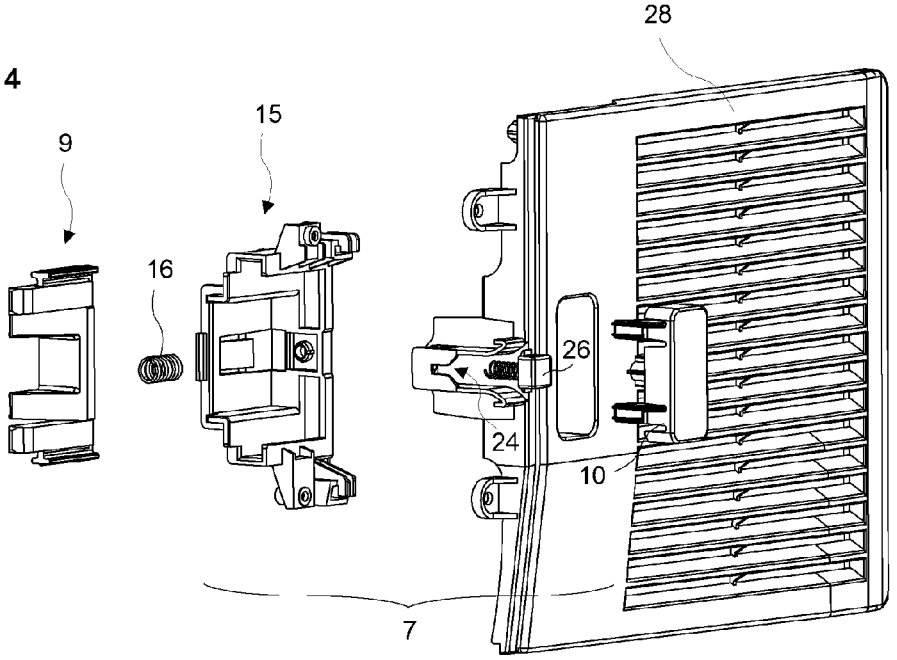

FIG. 4—is the exploded view of the panel, the release mechanism and the lock.

Figure 5:
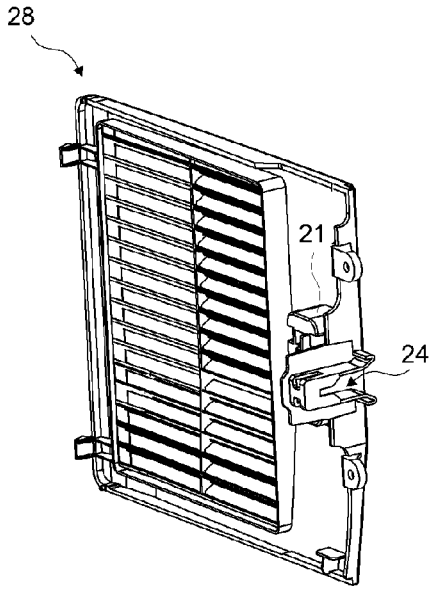

FIG. 5—is the rear perspective view of the panel.

Figure 6:
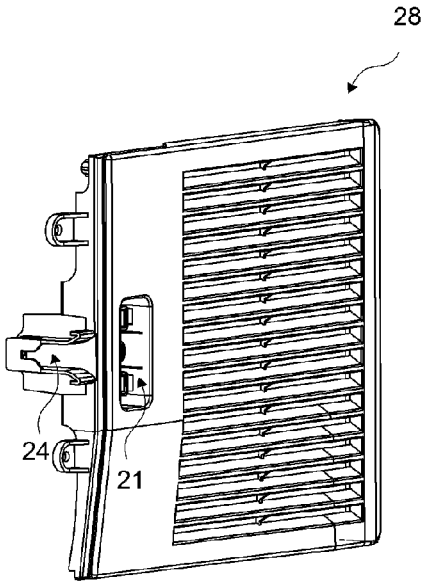

FIG. 6—is the front perspective view of the panel.

Figure 7:
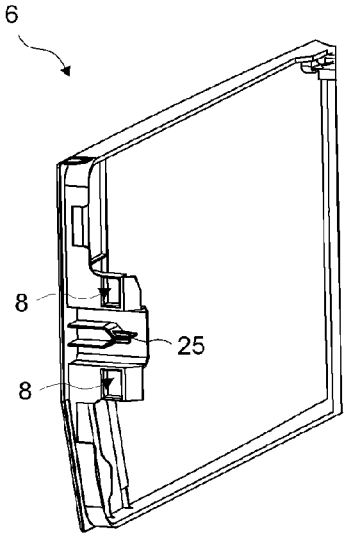

FIG. 7—is the perspective view of the lid.

Figure 8:
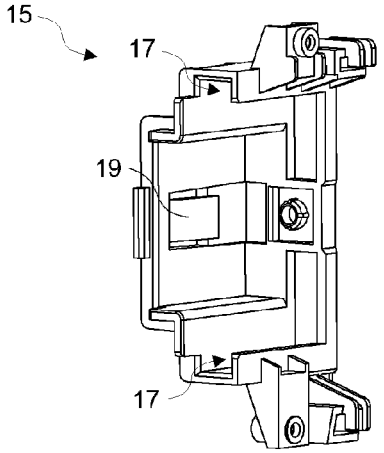

FIG. 8—is the perspective view of the bearing.

Figure 9:
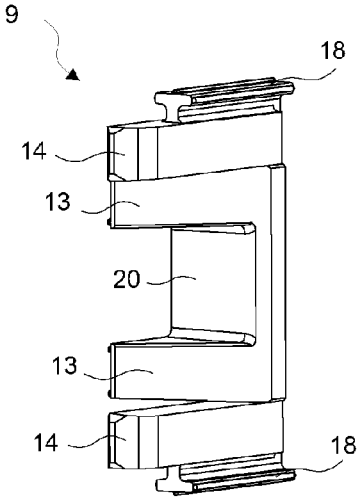

FIG. 9—is the front perspective view of the lock.

Figure 10:
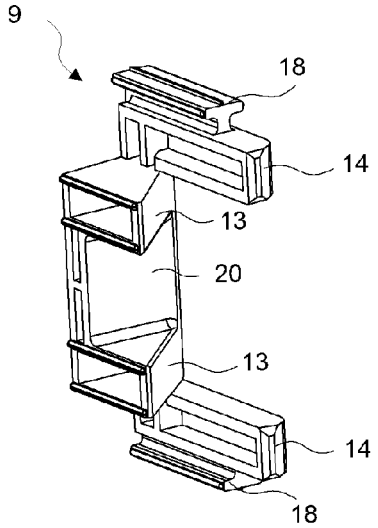

FIG. 10—is the rear perspective view of the lock.

Figure 11:
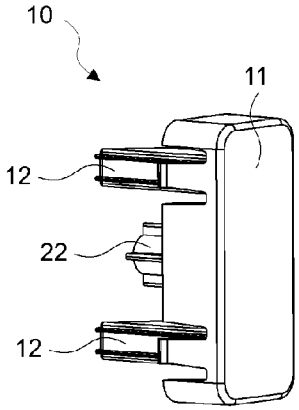

FIG. 11—is the front perspective view of the pusher.

Figure 12:
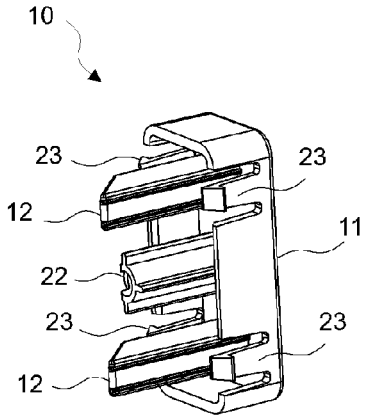

FIG. 12—is the rear perspective view of the pusher.

The elements illustrated in the figures are numbered as follows:

1. Dryer
2. Body
3. Drum
4. Opening
5. Dismountable member
6. Lid
7. Release mechanism
8. Housing
9. Lock
10. Pusher
11. Button
12. Push aim
13. Pressing surface
14. Tenon
15. Bearing
16. Spring
17. Rail
18. Slide
19. Stopper
20. Support
21. Casing
22. Extension
23. Detent means
24. Recess
25. Protrusion
26. Prestress means
27. Front wall
28. Panel The dryer (1) of the present invention comprises a body (2), a drum (3) disposed inside the body (2), wherein the laundry to be dried is placed, an opening (4) which is situated on the body (2), a dismountable member (5) which is placed into the body (2) by being passed through the opening (4), whereon the particles in the air leaving the drum (3) are accumulated and a lid (6) which covers the opening (4) so as to close the front of the dismountable member (5) (FIG. 1).

The dryer (1) of the present invention furthermore comprises a release mechanism (7) disposed on the body (2), which transforms the vertical force applied thereon into the horizontal force when triggered and thus provides the lid (6) to be opened. Thus, when the user desires to open the lid (6) for reaching the dismountable member (5), he/she can provide the lid (6) to be easily opened by actuating the release mechanism (7).

In an embodiment of the present invention, the dryer (1) comprises at least one housing (8) located on the lid (6) and at least one lock (9) disposed on the body (2), which provides the lid (6) to be kept in the closed position by being placed into the housing (8) when the lid (6) is in the closed position.

In this embodiment, the release mechanism (7) comprises a pusher (10), when actuated by the user, which pushes the lock (9) by moving in the direction vertical to the body (2) and provides the lock (9) to move in the horizontal direction and to come out of the housing (8). Thus, when the user actuates the pusher (10) by pressing in the horizontal direction, the lock (9) is provided to come out of the housing (8) and the lid (6) to be opened by becoming free.

In an embodiment of the present invention, the pusher (10) comprises a button (11) suitable for being actuated by the user, at least one push arm (12) connected to the button (11), the end of which is inclined and which extends towards into the body (2) perpendicularly to the button (11).

In this embodiment, the lock (9) comprises at least one pressing surface (13) onto which the inclined end of the push arm (12) is seated and which is inclined in the direction opposite to the end of the push arm (12) and at least one tenon (14) extending in the direction vertical to the push arm (12), which provides the lid (6) to be kept in the closed position by being placed into the housing (8) when the lid (6) is in the closed position and which comes out of the housing (8) by sliding in the horizontal direction and provides the lid (6) to become free as a result of the force applied on the pressing surface (13) by the push arm (12) when the user moves the push arm (12) towards into the body (2) by pressing the button (11).

In an embodiment of the present invention, the dryer (1) comprises a bearing (15) fixed to the body (2) and whereinto the lock (9) is placed so as to move in the horizontal direction. In this embodiment, the release mechanism (7) furthermore comprises a spring (16) placed between the bearing (15) and the lock (9), compressed when the tenon (14) moves in the direction to come out of the housing (8) by the user actuating the pusher (10) and which enables the tenon (14) to resume the locking position by becoming free when the force applied on the pressing surface (13) is removed when the user releases the pusher (10).

In a derivative of this embodiment, the lock (9) comprises two slides (18) disposed on its two sides, which enable the lock (9) to be placed into the bearing (15) so as to move in the horizontal direction and the bearing (15) comprises two rails (17) into which the slides (18) are seated. Thus, the lock (9) is provided to move inside the bearing (15) in an easy and balanced manner.

In an embodiment of the present invention, the bearing (15) furthermore comprises a stopper (19) which limits the movement of the lock (9) in the horizontal direction and prevents the lock (9) from coming out of the bearing (15) with the pressure applied by the spring (16) when the lid (6) is open. The stopper (19) is preferably in the form a detent means against which the lock (9) bears when the lid (6) is open.

In an embodiment of the present invention, the lock (9) comprises two tenons (14), two pressing surfaces (13) disposed between the tenons (14) and a support (20) in the form of a plate, extending between the two pressing surfaces (13), contacted by the spring (16) from behind and by the stopper (19) from the front. In this embodiment, the pusher (10) comprises two push arms (12) disposed at the level of the pressing surfaces (13).

In an embodiment of the present invention, the dryer (1) furthermore comprises a casing (21) disposed on the body (2) and into which the pusher (10) is placed so as to move perpendicularly to the body (2).

In a derivative of this embodiment, the pusher (10) comprises an extension (22) in asymmetrical form which allows the pusher (10) to be mounted into the casing (21) only such that the inclined end of the push arm (12) is seated onto the pressing surface (13). Thus, the problems that can occur as a result of the placement of the pusher (10) into the casing (21) inversely during assembly are eliminated.

In a derivative of this embodiment, the pusher (10) comprises detent means (23) that prevent the pusher (10) from coming out of the casing (21).

In an embodiment of the present invention, the dryer (1) furthermore comprises a recess (24) disposed on the body (2), a protrusion (25) disposed on the lid (6) and which is placed into the recess (24) when the lid (6) is closed and a prestress means (26) disposed in the recess (24), compressed when the protrusion (25) is seated into the recess (24) and which provides the lid (6) to be opened quickly by transmitting the energy stored therein as a result of being compressed when the lid (6) becomes free as the tenon (14) comes out of the housing (8).

In an embodiment of the present invention, the opening (4) and hence the lid (6) are disposed at the front lower side of the body (2), at the region of the kick plate, close to its base.

In a derivative of this embodiment, the body (2) comprises a front wall (27) which covers the front surface of the body (2) to the level of the lid (6) and a panel (28) which covers the portion that remains below the front wall (27), near the lid (6) and whereon the casing (21) and the recess (24) are disposed.

In an embodiment of the present invention, the dryer (1) is of the heat pump type and the dismountable member (5) is a filter.

In another embodiment of the present invention, the dryer (1) is of conventional type and the dismountable member (5) is a condenser.

In yet another embodiment of the present invention, the dryer (1) is of conventional type and the dismountable member (5) is a condenser group that contains a condenser and filter.

By means of the present invention, a dryer (1) wherein the user can easily reach the dismountable member (5) for performing the cleaning operation is realized.

It is to be understood that the present invention is not limited to the embodiments disclosed above and a person skilled in the art can easily introduce different embodiments. These should be considered within the scope of the protection postulated by the claims of the present invention.

The invention claimed is:

1. A dryer comprising:

a body;

a drum disposed inside the body, wherein laundry to be dried is placed;

an opening which is situated on the body;

a dismountable member which is placed into the body by being passed through the opening, whereon particles in air leaving the drum are accumulated, a lid which covers the opening in a closed position so as to close a front of the dismountable member, a release mechanism disposed on the body, which transforms a force applied thereon in a first direction perpendicular to the body into a force in a second direction perpendicular to the first direction when actuated to open the lid, at least one housing located on the lid, and a lock disposed on the body, which maintains the lid in the closed position by being placed into engagement with the at least one housing when the lid is in the closed position, and the release mechanism having a pusher, which provides the force in the second direction, pushes the lock when the pusher is moved in the first direction perpendicular to the body when actuated by a user, resulting in the lock sliding in the second direction so as to come out of engagement with the at least one housing, wherein the pusher comprises a button suitable for being actuated by the user such that the force applied in the first direction is applied by the user to the button, causing the pusher to move in the first direction, and at least one push arm connected to the button and having an inclined end and extending towards the body perpendicularly to the button, wherein the lock comprises at least one pressing surface for seating the inclined end of the at least one push arm and the at least one pressing surface is inclined in a direction opposite to the inclined end of the at least one push arm, and at least one tenon extending in a direction perpendicular to the at least one push arm, which maintains the lid in the closed position by being placed into engagement with the at least one housing when the lid is in the closed position and which comes out of engagement with the at least one housing by sliding in the second direction and causing the lid to be opened as a result of a force applied on the at least one pressing surface by the at least one push arm when the user actuates the button, causing the pusher to move in the first direction resulting in the at least one push arm moving towards the body, wherein a bearing is fixed to the body, wherein the lock comprises two slides disposed adjacent to and extending parallel to the at least one tenon, wherein the two slides are provided on two opposite ends of the lock, wherein the two slides protrude from the lock in an upward vertical direction and in a downward vertical direction, respectively, and wherein the two slides are received in two rails disposed at two opposite ends of the bearing such that the two slides enable the lock to be placed into the bearing so as to be slidable in the second direction, wherein a casing is disposed on the body.

2. The dryer as in claim 1, wherein the release mechanism comprises a spring placed between the bearing and the lock, which is compressed when the at least one tenon moves in the second direction to come out of engagement with the at least one housing by the user actuating the button of the pusher and which enables the at least one tenon to resume an extended position when the force applied on the at least one pressing surface is removed when the user releases actuation of the button.

3. The dryer as in claim 2, wherein the at least one pressing surface comprises a first pressing surface and a second pressing surface, and wherein the bearing comprises a stopper configured to contact a support disposed between the first pressing surface and the second pressing surface, in order to limit the sliding of the lock in the second direction and prevent the lock from coming out of the bearing under pressure applied by the spring when the lid is open.

4. The dryer as in claim 3, wherein the at least one tenon comprises two tenons, wherein the first and second pressing surfaces are disposed between the two tenons, wherein a back surface of the support is contacted by the spring and a front surface of the support is contacted by the stopper, and wherein the at least one push arm of the pusher comprises two push arms disposed at the first and second pressing surfaces, respectively.

5. The dryer as in claim 1, wherein the pusher comprises an extension in asymmetrical form which allows the pusher to be mounted into the casing only such that the inclined end of the at least one push arm is seated onto the at least one pressing surface.

6. The dryer as in claim 1, wherein the pusher is located within the casing and comprises detent means that prevent the pusher from coming out of the casing.

7. The dryer as in claim 1, wherein the dryer is a heat pump type dryer and wherein the dismountable member is a filter.

8. The dryer as in claim 1, wherein the dryer is a heat pump type dryer or a conventional type dryer and wherein the dismountable member is a condenser.

9. The dryer as in claim 1, wherein the dryer is a heat pump type dryer or a conventional type dryer and wherein the dismountable member is one of a condenser group that contains a condenser and a filter.

* * * * *